US005702160A

United States Patent [19]

Levankovskii et al.

[11] Patent Number: 5,702,160

[45] Date of Patent: Dec. 30, 1997

[54] TOOL FOR CRUSHING HARD MATERIAL

[76] Inventors: Igor Anatolyevich Levankovskii, Leningradskii pr-t, d. 27, kv. 42, Moscow 125040; Yurii Alexandrovich Grinevitskii, ul. Fonivisina, d. 13, kv. 12, Moscow 127322; Victor Danilovich Shults, ul. Krasnii Mayak, d. 15, korp. 2, kv. 107, Moscow 113570; Yurii Victorovich Alexandrov, poselok VUGI, d. 24, kv. 18, Miscovskaya oblast g. Luberzy 140004, all of Russian Federation

[21] Appl. No.: 693,294

[22] PCT Filed: Feb. 16, 1995

[86] PCT No.: PCT/RU95/00025

§ 371 Date: Aug. 16, 1996

§ 102(e) Date: Aug. 16, 1996

[87] PCT Pub. No.: WO96/25585

PCT Pub. Date: Aug. 22, 1996

[51] Int. Cl.[6] ..... F21C 35/183

[52] U.S. Cl. ..... 299/111; 299/113

[58] Field of Search ..... 299/111, 113

[56] References Cited

U.S. PATENT DOCUMENTS 5,074,623 12/1991 Hedlund et al. ..... 299/111

5,141,289 8/1992 Stiffler ..... 299/111

5,161,859 11/1992 Larsson et al. ..... 299/111

5,219,209 6/1993 Prizzi et al. ..... 299/111

FOREIGN PATENT DOCUMENTS 2846744 4/1980 Germany ..... 299/111

*Primary Examiner*—David J. Bagnell

*Attorney, Agent, or Firm*—Beveridge, DeGrandi, Weilacher & Young, LLP

[57] ABSTRACT

The concept of invention: a tool for crushing hard material comprises a housing and a hard-alloy insert mounted on the latter. The insert is made up of a head portion, an intermediate portion and a base with a thrust face. The intermediate portion of the insert is formed by a body of revolution with an outer lateral surface of concave shape. The head portion of the insert is formed by a body of revolution with an outer lateral surface of convex shape. The lateral side of the head portion of the insert is smoothly located adjacent to the lateral side of the intermediate portion of the insert. The length of the intermediate portion of the insert about its longitudinal axis does not exceed the length of the head portion of the insert about the same axis.

20 Claims, 1 Drawing Sheet

Figures 1, 2, 3, 4, 5, 6:
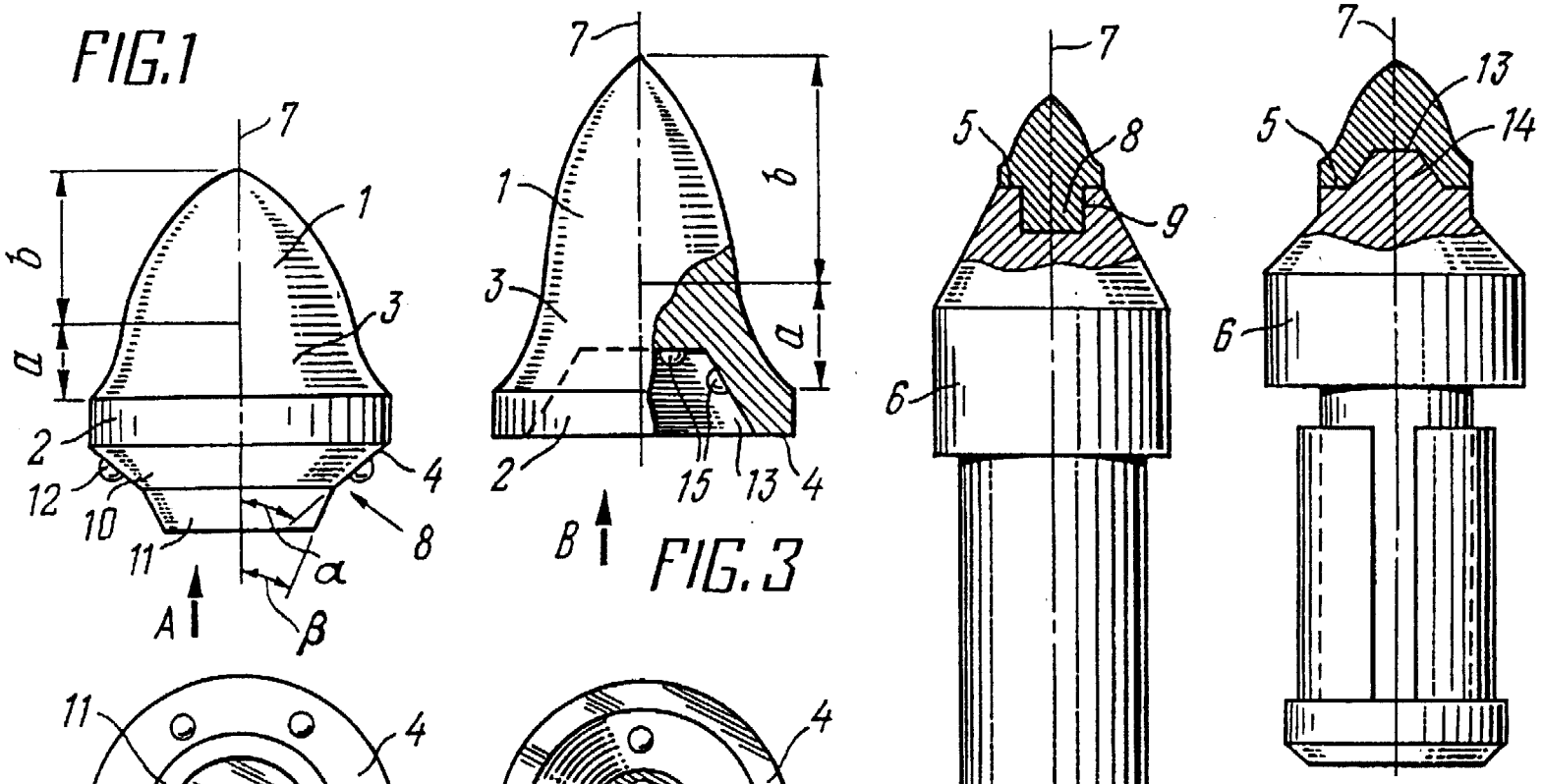

A
B
α
β
q
D

TOOL FOR CRUSHING HARD MATERIAL

The invention relates to the mining industry, more specifically to a cutting tool for mining and construction machines, and can be used in breaking rock and artificial materials, say, roadway coverings.

Known in the art is a rock breaking tool for the mining machines, which comprises a housing and a hard-alloy insert mounted on the housing, said insert having a work portion of conic shape and a shank tapering towards the end of the insert and intended for arrangement in the nest of said housing of the tool (cf. USSR Inventor's Certificate No. 1245696, cl. E21C 25/38, published 1986) (1).

Known from (1) is a tool for breaking a hard material displaying sufficient strength and durability, which provide the sufficient operating life thereof in operating conditions, on crushing hard materials. However, the geometric form of the work portion of the insert is not optimal as to consumption of hard-alloy material that goes for its manufacture. Inasmuch as for making an insert, use is made usually of a metal ceramics hard-alloy of a tungsten-cobalt group, then of substantive importance is a task of reducing the consumption of hard-alloy materials (scarce tungsten) for manufacturing the insert and, hence, of effecting a cost saving in the manufacture of the tool upon the whole. The hard-alloy insert with a work portion of conic shape calls for its manufacture a considerable amount of a material in short supply, a factor that entails a considerable rise in the cost of manufacturing the tool.

Closest as to technical essence and attainable result is a tool for breaking hard material, which comprises a housing and a hard-alloy insert mounted on the housing and having a head portion, a base with a thrust face for cooperation with a supporting surface of the housing and an intermediate portion disposed between the head portion and the base and formed by a body of revolution with an external lateral surface of concave shape (cf. FRG Application No. 3317441, cl. B28D I/28, published 1984)(2).

The structural peculiarities of a known tool for crushing hard material allow one to improve efficiency of a process of breaking the hard material by reducing a cutting force by choosing the rational geometric characteristics of the work portion of an insert and, so, to reduce the consumption of a hard-alloy going for the manufacture of the insert, i.e., effect a cost saving in manufacturing the tool. However, the tool known from (2) of the type used for breaking the hard material exhibits no sufficiently high lasting quality, since optimization of the geometric shape of the work portion of said insert as to the amount of said hard-alloy usable for its production does not contribute to required strength and wear resistance of the hard-alloy insert and, consequently, the lasting quality of the tool is reduced as a whole, in other words, the operating life of the tool with the hard-alloy insert of said type is not high enough.

It is the task of the invention to create a tool for breaking hard material which would have a sufficiently high durability and at the same time would make for a reduction of the cost of manufacturing the tool.

The task set is solved owing to the fact that in the tool for breaking hard material, comprising a housing and a hard-alloy insert mounted on the housing and provided with a head portion, a base with a thrust face for interaction with the supporting surface of the housing and an intermediate portion disposed between said head portion and said base and formed by a body of revolution with an external lateral surface of concave shape, the head portion of the insert is formed by a body of revolution with an external lateral surface of convex shape, and the lateral side of the head portion of said insert has smooth conjugation with the lateral side of its intermediate portion, and along with this, the length of the intermediate portion of the insert about its longitudinally extending axis does not exceed the head portion of the insert about the same axis.

Besides, owing to the fact that the base of the insert has the shape of a cylinder of rotation, whose longitudinal axis is arranged on the longitudinal axis of symmetry of the insert.

Besides, owing to the fact that the insert has a shank for arrangement in the nest of the housing of said tool.

Besides, owing to the fact that the shank of said insert has the shape of two truncated cones of rotation which are conjugated therebetween at the bases thereof having their axes arranged on the longitudinal axis of symmetry of the insert, and moreover the diameter of a greater base of one truncated cone is equal to the diameter of the base of the insert, and along with this, the verticies of the truncated cones are oriented in one direction with respect to said insert base.

Besides, owing to the fact that the angle of inclination of the generating line of a truncated cone, that is located adjacent to said insert base, to the longitudinal axis of symmetry of the insert constitutes at least 30° and no more than 80°.

Besides, owing to the fact that the angle of inclination of the generating line of a truncated cone, that is conjugate by its greater base with a smaller base of the other truncated cone, to the longitudinal axis of symmetry constitutes at least 78° and no more than 86°.

Besides, owing to the fact that the shank of the insert has projections for centring the insert in the nest of the housing of the tool and for forming a predetermined layer of material for connection of the insert with said housing of the tool.

Besides, owing to the fact that the projections are provided on the lateral side of a truncated cone which is adjacent the base of the insert.

Besides, owing to the fact that the projections are arranged uniformly around the circumference, whose center lies on the longitudinal axis of symmetry of the insert.

Besides, owing to the fact that the projections are six in number.

Besides, owing to the fact that the insert has a nest for a projection being arranged at the end of the housing of said tool.

Besides, owing to the fact that the nest has projections for centring the insert with respect to the projection at the end of the housing of said tool and for forming a predetermined layer of material for connecting the insert to the housing of said tool.

Besides, owing to the fact that projections are disposed on the walls of the nest of said tool.

Besides, owing to the fact that projections are provided on the bottom of said nest of said insert.

Besides, owing to the fact that the projections are arranged uniformly around the circumference, whose center lies on the longitudinal axis of symmetry of the insert.

The essence of the invention is explained by the drawings where

FIG. 1 shows a hard-alloy insert with the shank of a tool for breaking hard material;

FIG. 2—a view along A in FIG. 1;

FIG. 3—a hard-alloy insert with a nest for a tool for breaking hard material;

FIG. 4—a view along B in FIG. 3;

FIG. 5—a tool for breaking hard material, general view; and

FIG. 6—an alternative embodiment of the structural realization of a tool for breaking hard material.

The tool for breaking hard material comprises a hard-alloy insert (FIGS. 1, 2, 3, 4) which comprises a head portion 1 formed by a body of revolution with an external lateral surface of convex shape and an intermediate portion 3 disposed between a base 2 of the insert and the head portion 1 of the insert and formed by a body of revolution with an external lateral side of concave shape. The base 2 of the insert has a thrust face 4 for cooperation with a supporting surface 5 of a housing 6 of the tool. The lateral surface of the head portion 1 of the insert has smooth conjugation with the lateral side of the intermediate portion 2 of the insert. The length (a) of the intermediate portion 3 of the insert about a longitudinal axis 7 of symmetry of the insert does not exceed the length (b) of the head portion 1 of the insert about the same axis 7, i.e. the ratio of the lengths of the intermediate portion 3 of the insert and the head portion 1 of the insert satisfies the relation $a \leqq b$.

Said ratio has been defined empirically which is helpful in specifying the most favourable geometric parameters of the work portion of the hard-alloy insert with which is achieved a maximal wear resistance of the hard-alloy insert. It is worthy of note that in case of departing from the bounds of said ratio between the intermediate portion 3 of the insert and the head portion 1 of the insert, the task set cannot be solved, as shown by the investigations conducted, i.e., the servive life of said hard-alloy insert is reduced sharply.

The base 2 of a hard-alloy insert can have the shape of a truncated cone, prism or cylinder (not shown). Most preferable is the embodiment of the base 2 of the insert in the form of a cylinder of rotation having its longitudinal axis extending on the longitudinal axis 7 of symmetry of the insert. This shape of the realization of base 2 of the insert allows one to lower the consumption of a hard alloy and to increase the strength of connection of the insert with the housing 6 of the tool.

The base 2 of the insert can have the flat thrust face 4 (FIG. 3) in which case the supporting surface 5 of the housing 6 of the tool should likewise have flat shape and mounting of the hard-alloy insert on the housing 6 of the tool can here be done by, say, diffusion welding. To increase the securing strength of said hard-alloy insert on the housing 6 of the tool, the insert can be provided with a shank 8 at the end of its base 2 (FIG. 5), and the housing 6 of the tool has in this particular case a nest 9 for the arrangement of the shank 8 of the insert. It should be noted that it is most desirable that the shank 8 of the insert be adapted to suit the contour of the nest 9 at the end of the housing 6 of the tool.

The shank 8 of the insert can be in configuration conforming to a truncated cone, prism or cylinder (FIG. 5). It is most preferable to make the shank 8 of the insert in the form of two truncated cones 10 and 11 of rotation which are conjugate therebetween at the bases thereof, whose axes are arranged on the longitudinal axis of symmetry 7 of the insert. The diameter of a larger base of the truncated cone 10 is equal to the diameter of the base 2 of the insert. Moreover, the verticies of said truncated cones 10, 11 forming the shank 8 of the insert are oriented in one direction with respect to the base 2 of the insert, i.e., the outside diameter of shank 8 is gradually reduced from the base 2 of the insert to the end portion of shank 8 of the insert. Such an embodiment of the shank 8 of the insert enables one to lower consumption of hard-alloy material and simultaneously preserve the strength characteristics of connection of the hard-alloy insert with the housing 6 of the tool.

It is preferable to realize the truncated cone 10 adjacent the base 2 of the insert with an angle of inclination ($\alpha$) of its generating line to the longitudinal axis 7 of symmetry of the insert being at least 30° and no more than 80°.

It is advisable that an angle of inclination ($\beta$) of the generating line of truncated cone 11 which is conjugate by its larger base with a smaller base of the truncated cone 10, to the longitudinal axis 7 of symmetry of the insert be at least 78° and no more than 86°.

The afore-said optimal ranges of angles ($\alpha$) and ($\beta$) have been determined experimentally to provide the minimal consumption of hard-alloy material for the manufacture of the insert and assure the maximal strength of connection of the hard-alloy insert with the housing 6 of the tool.

The shank 8 of the insert can have projections 12 for centring the insert in the nest 9 of the housing 6 of the tool and for forming the specified layer (not shown) of material to connect the insert with the housing 6 of the tool. The projections 12 are desired to be provided on the lateral side of the truncated cone 10 which is adjacent the base 2 of the insert. Besides, the projections 12 can be arranged and/or on the lateral side of the truncated cone 11 and/or on the end face of the shank 8 (not shown).

For a more precise centring of a hard-alloy insert about the longitudinal axis of symmetry of the housing 6 of the tool and consequently for a more uniform wear-out of the tool in operation, the projections 12 can advantageously be arranged uniformly about a circle, whose center lies on the longitudinal axis 7 symmetry of the hard-alloy insert.

It is preferred to provide six projections 12 on the shank 8 of the insert.

An increase in strength of the connection of a hard-alloy insert with the housing 6 of the tool and a reduction of consumption of hard-alloy material can be ensured by making an insert with a nest 13 (FIG. 3), in which case the housing 6 of the tool ought to have a projection 14 (FIG. 6) for arrangement in the nest 13 of the insert. The shape of nest 13 provided on the end portion of base 2 of the insert may be whatever desired, say, in configuration conforming to a truncated cone or a prism. The shape of a projection 14 on the housing 6 of the tool should preferably be adapted to suit the contour of the nest 13 of the hard-alloy insert. It is preferable to have said nest 13 provided in the insert of a shape with which the lateral extent of the walls of said nest 13 is gradually diminished towards the bottom of the nest 13 in the insert. The hard-alloy insert can be connected with the housing 6 of the tool with the aid of, say, solder to be disposed in-between the insert and the housing 6 of the tool.

For centring a hard-alloy insert with respect to the housing 6 of the tool, namely, the projection 14 on the said tool housing 6 and for forming the pre-determined layer (not shown) of material for connection of said hard-alloy insert with said housing 6 of the tool, the nest 13 in the insert can have projections 15 to be arranged, if necessary, in the bottom of said nest 13 in the insert and/or on the walls of the nest 13 in the insert.

The projections 15 in the nest 13 of a hard-alloy insert are desired to be arranged about a circle with its center situated on the longitudinal axis 7 of symmetry of the insert.

The tool for crushing hard material is operated in the following manner.

In operation, a hard-alloy insert mounted on a housing 6 is in cooperation with the material being crushed in the process of cutting, with a furrow formed on the surface of the material crushed. The geometric form of the outer lateral side of the hard-alloy insert contributes to the best strength and tool resistance in operation, since the nature of a change in the overall dimensions of cross-section of the hard-alloy insert corresponds to the nature of a change in the bending moment developing in the insert during its cooperation with the material being crushed. Moreover, for manufacturing the hard-material breaking tool, an amount of the required hard-alloy material is minimal, a factor that enables one to reduce the cost of said tool manufacture to an optimal minimum.

We claim:

1. A tool for crushing hard material, comprising a housing and a hard-alloy insert mounted on the housing and having a head portion, a base with a thrust face for interaction with a supporting surface of the housing and an intermediate portion interposed between the head portion and the base and formed by a body of revolution with an outer lateral surface of concave shape, characterized in that the head portion of the insert is formed by a body of revolution with an outer lateral surface of convex shape, and the lateral side of said head portion of the insert is smoothly located adjacent to the lateral surface of its intermediate portion, the length of the intermediate portion of the insert about its longitudinal axis not exceeding the length of the head portion of the insert about the same axis.

2. A tool as claimed in claim 1, characterized in that the base of the insert has the shape of a cylinder of rotation, whose longitudinal axis is arranged on the longitudinal axis of symmetry of the insert.

3. A tool according to claim 2, characterized in that the insert has a shank for arrangement in a nest of the housing of the tool.

4. A tool according to claim 2, characterized in that the insert has a nest for the arrangement of a projection on the end portion of the housing of the tool.

5. A tool according to claim 1, characterized in that the insert has a shank for arrangement in a nest of the housing of the tool.

6. A toll as claimed in claim 5, characterized in that the shank has the shape of two truncated cones of rotation which are inter-conjugated at the bases thereof and the axes of which are arranged on the longitudinal axis of symmetry of the insert, the diameter of a larger base of a truncated cone being equal to the diameter of the base of the insert, the verticies of said truncated cones being oriented in one direction in relation to the base of the insert.

7. A tool as claimed in claim 6, characterized in that an angle of inclination of the generating line of a truncated cone which adjoins the base of the insert, to the longitudinal axis of symmetry of the insert constitutes at least 30° and no more than 80°.

8. A tool as claimed in claim 6, characterized in that the angle of inclination of the generating line of a truncated cone being conjugate at its larger base with a smaller base of the other truncated cone, to the longitudinal axis of symmetry is at least 78° and no more than 86°.

9. A tool as claimed in claim 6, characterized in that the shank of the insert has projections for centering the insert in the nest of the housing of said tool and for forming the specified layer of material for the connection of the insert with the housing of the tool.

10. A tool as claimed in claim 5, characterized in that the shank of the insert has projections for centring the insert in the nest of the housing of said tool and for forming the specified layer of material for the connection of the insert with the housing of the tool.

11. A tool as claimed in claim 10, characterized in that the projections are arranged on the lateral surface of a truncated cone which is adjacent the base of the insert.

12. A tool as claimed in claim 11, characterized in that the projections are uniformly arranged about a circle whose center is situated on the longitudinal axis of the insert.

13. A tool as claimed in claim 10, characterized in that the projections are uniformly arranged about a circle whose center is situated on the longitudinal axis of the insert.

14. A tool as claimed in claim 10, characterized in that the number of projections is six.

15. A tool according to claim 1, characterized in that the insert has a nest for the arrangement of a projection on the end portion of the housing of the tool.

16. A tool according to claim 15, characterized in that the nest has projections for centring the insert with respect to a projection on the end portion of the housing of the tool and for forming the specified layer of material for connection of the insert with the housing of the tool.

17. A tool according to claim 16, characterized in that the projections are provided in the bottom of the nest of the insert.

18. A tool as claimed in claim 17, characterized in that the projections are arranged on the walls of the nest of the insert.

19. A tool as claimed in claim 16, characterized in that the projections are arranged on the walls of the nest of the insert.

20. A tool as claimed in claim 16, characterized in that the projections are uniformly arranged about a circle with its center situated on the longitudinal axis of symmetry of the insert.

* * * * *